US011377802B2

(12) United States Patent
Oetken

(10) Patent No.: US 11,377,802 B2
(45) Date of Patent: Jul. 5, 2022

(54) COMPACTION MACHINE

(71) Applicant: Caterpillar Paving Products Inc., Brooklyn Park, MN (US)

(72) Inventor: Nicholas Alan Oetken, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 315 days.

(21) Appl. No.: 16/678,652

(22) Filed: Nov. 8, 2019

(65) Prior Publication Data

US 2021/0140127 A1 May 13, 2021

(51) Int. Cl.
*E01C 19/26* (2006.01)

(52) U.S. Cl.
CPC ..... *E01C 19/264* (2013.01); *E01C 19/266* (2013.01); *E01C 19/268* (2013.01)

(58) Field of Classification Search
CPC ..... E01C 19/264; E01C 19/266; E01C 19/268
USPC ..... 404/117, 122, 123, 127, 128, 131, 132
See application file for complete search history.

(56) References Cited

U.S. PATENT DOCUMENTS 1,052,643 A * 2/1913 Baechle ..... E01C 19/27 404/132
1,831,116 A * 11/1931 De Witt ..... E01C 19/236 404/132
2,154,720 A * 4/1939 Biles ..... E01C 19/264 172/63
2,906,438 A * 9/1959 Carpenter ..... E01C 19/482 222/618
3,161,250 A * 12/1964 Gardner ..... B60K 17/165 180/24.04
3,192,838 A * 7/1965 Cook ..... E02D 3/026 404/132
3,229,602 A * 1/1966 Vivier ..... E01C 19/27 404/126
3,340,782 A * 9/1967 Novak ..... E02D 3/032 404/85
3,426,660 A * 2/1969 Edward ..... E01C 19/283 404/117
3,895,880 A * 7/1975 Fink ..... E01C 19/266 404/86
4,157,877 A * 6/1979 Lee ..... E01C 19/231 172/395

(Continued)

FOREIGN PATENT DOCUMENTS

CN 102587264 6/2014
CN 203625751 6/2014
DE 2061966 11/1979

*Primary Examiner* — Raymond W Addie
(74) *Attorney, Agent, or Firm* — von Briesen & Roper, s.c.

(57) ABSTRACT

A compaction machine includes a frame and at least one compaction member rotatably mounted to the frame. The compaction machine also includes at least one pneumatic tire movably coupled to the frame. The at least one pneumatic tire is disposed on at least one of a first side and a second side of the at least one compaction member and adjacent to an edge of the at least one compaction member. The at least one pneumatic tire is adapted to selectively move between a deployed position and a retracted position. In the retracted position, the at least one pneumatic tire is raised relative to a work surface. In the deployed position, the at least one pneumatic tire is adapted to provide selective compaction of a portion of the work surface.

20 Claims, 5 Drawing Sheets

(56) References Cited

U.S. PATENT DOCUMENTS

| | | | | |
|---|---|---|---|---|
| 5,114,269 | A * | 5/1992 | Shepherd | E01C 19/236 404/122 |
| 5,336,019 | A * | 8/1994 | Hollon | E01C 19/264 404/127 |
| 5,395,182 | A * | 3/1995 | Rossburger | E01C 19/27 404/122 |
| 7,354,222 | B2 | 4/2008 | Satzler | |
| 7,497,642 | B2 * | 3/2009 | Raymond | E01C 19/26 404/117 |
| 8,137,026 | B2 * | 3/2012 | Lura | E04G 21/10 404/118 |
| 8,500,363 | B1 | 8/2013 | Ries et al. | |
| 9,422,675 | B2 | 8/2016 | Bornemann et al. | |
| D861,739 | S * | 10/2019 | Fox | D15/28 |
| 2015/0167258 | A1 * | 6/2015 | Ries | E01C 19/29 404/84.05 |
| 2015/0184347 | A1 | 7/2015 | Lantez et al. | |

* cited by examiner

COMPACTION MACHINE

TECHNICAL FIELD

The present disclosure relates to a compaction machine. More particularly, the present disclosure relates to a pneumatic tire for the compaction machine and a pressure control system for the pneumatic tire.

BACKGROUND

During paving of a work surface, a paving machine is used to form an asphalt layer over the work surface. In many situations, a width of the work surface may be greater than a width of the paving machine. In such a situation, two or more paving passes may be performed, or multiple paving machines may be employed in order to pave a complete width of the work surface, in turn, increasing process time and process cost. Accordingly, two or more asphalt layers may be formed on the work surface, such that the asphalt layers may be disposed adjacent to one another.

In such a situation, a compaction machine may perform multiple passes in order to compact an adjacent portion of the asphalt layers in addition to performing compaction of a remaining portion of the asphalt layers. This may increase number of compaction passes required by the compaction machine, in turn, increasing process time and cost. In some situations, a specialized compaction machine may be employed in order to perform compaction of the adjacent portion and the remaining portion of the asphalt layers, simultaneously, in a single compaction pass. Such a specialized machine may have pneumatic wheels in addition to a compaction drum, in turn, increasing equipment and process cost.

In some situations, such as during compaction of an edge portion of the asphalt surface, a lower compaction pressure may be required. A higher compaction pressure may result in excessive compaction and/or flow out of the asphalt over the work surface, in turn, reducing compaction quality. In such a situation, a relatively smaller compaction machine may be employed in order to perform compaction of the edge portion of the asphalt surface, in turn, increasing equipment and process cost. Hence, there is a need for an improved compaction machine for such applications.

U.S. Pat. No. 9,422,675 describes a compactor having at least one compactor roller, at least one edge shaping device, and a fluid reservoir/delivery system. The at least one compactor roller rotates around a roller axis of rotation. The fluid reservoir/delivery system stores and delivers fluid to the compactor roller and the edge shaping device. The fluid reservoir/delivery system includes at least one first fluid pump for pumping fluid to at least one first fluid delivery unit assigned to the compactor roller. The fluid reservoir/delivery system also includes at least one second fluid pump for pumping fluid to at least one second fluid delivery unit assigned to the edge shaping unit.

SUMMARY OF THE DISCLOSURE

In an aspect of the present disclosure, a compaction machine is provided. The compaction machine includes a frame defining a longitudinal axis. The compaction machine also includes at least one compaction member rotatably mounted to the frame. The at least one compaction member defines a first side and a second side disposed opposite to the first side. The compaction machine further includes at least one pneumatic tire movably coupled to the frame. The at least one pneumatic tire is disposed on at least one of the first side and the second side of the at least one compaction member and adjacent to an edge of the at least one compaction member. The at least one pneumatic tire is adapted to selectively move between a deployed position and a retracted position. In the retracted position, the at least one pneumatic tire is raised relative to a work surface. In the deployed position, the at least one pneumatic tire is adapted to provide selective compaction of a portion of the work surface.

In another aspect of the present disclosure, a pressure control system for at least one pneumatic tire associated with at least one compaction member of a compaction machine is provided. The pressure control system includes a pressure sensor disposed in association with the at least one pneumatic tire. The pressure sensor is configured to generate a signal indicative of an air pressure within the at least one pneumatic tire. The pressure control system includes a compressor unit fluidly coupled to the at least one pneumatic tire. The compressor unit is adapted to provide a flow of pressurized air to the at least one pneumatic tire. The pressure control system also includes a release valve fluidly coupled to the at least one pneumatic tire. The release valve is adapted to release the pressurized air from the at least one pneumatic tire. The pressure control system further includes a controller communicably coupled to each of the pressure sensor, the compressor unit, and the release valve. The controller is configured to receive the signal from the pressure sensor. The controller is also configured to actuate one of the compressor unit and the release valve based on a predefined pressure. The controller is further configured to control the air pressure within the at least one pneumatic tire at the predefined pressure.

In yet another aspect of the present disclosure, a method for controlling an air pressure within at least one pneumatic tire associated with at least one compaction member of a compaction machine is provided. The method includes receiving a signal indicative of the air pressure within the at least one pneumatic tire from a pressure sensor. The method also includes actuating one of a compressor unit and a release valve based on a predefined pressure. The method further includes controlling the air pressure within the at least one pneumatic tire at the predefined pressure.

Other features and aspects of this disclosure will be apparent from the following description and the accompanying drawings.

DETAILED DESCRIPTION

Figure 1A:
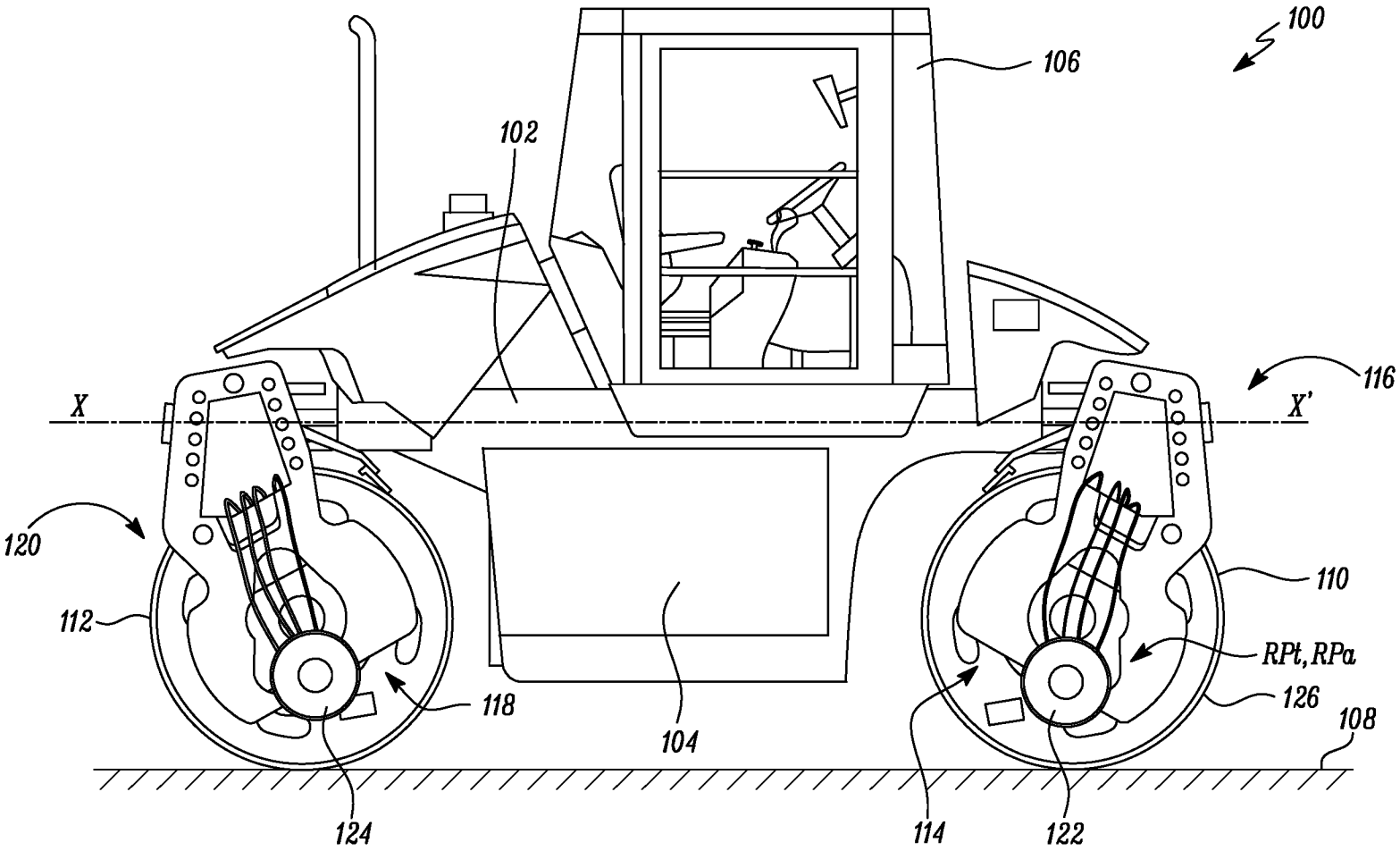
FIG. 1A is a perspective view of an exemplary compaction machine, according to one embodiment of the present disclosure.
Figure 1B:
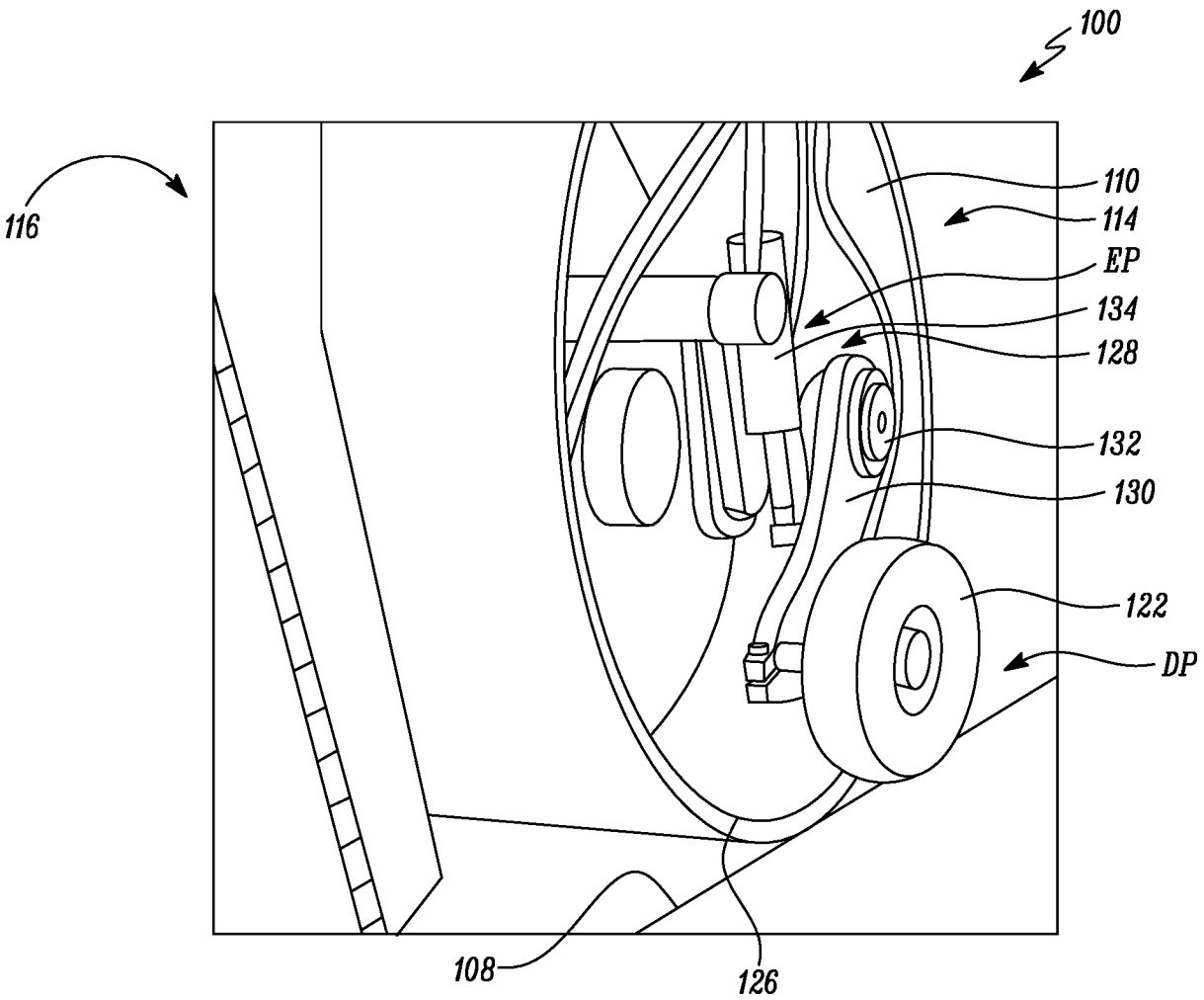
FIG. 1B is a perspective view of a portion of the compaction machine, according to one embodiment of the present disclosure.

Wherever possible, the same reference numbers will be used throughout the drawings to refer to the same or like parts. Referring to FIGS. 1A and 1B, different views of an exemplary compaction machine 100 are illustrated. The compaction machine 100 will be hereinafter interchangeably referred to as the "machine 100". In the illustrated embodiment, the machine 100 is a dual drum type compaction machine. In other embodiments, the machine 100 may be single or multi drum type compaction machine. Also, the machine 100 may be a vibratory type or a non-vibratory type compaction machine. The machine 100 may be associated with an industry, such as construction, mining, transportation, agriculture, waste management, and so on, based on application requirements.

The machine 100 includes a frame 102. The frame 102 defines a longitudinal axis X-X' of the machine 100. The frame 102 supports one or more components of the machine 100. The machine 100 includes an enclosure 104 provided on the frame 102. The enclosure 104 encloses a power source (not shown) mounted on the frame 102. The power source may be any power source, such as an internal combustion engine, batteries, motor, and so on, or a combination thereof. The power source may provide power to the machine 100 for mobility and operational requirements.

The machine 100 also includes an operator cabin 106 mounted on the frame 102. The operator cabin 106 houses one or more controls (not shown) of the machine 100, such as a display unit, a touchscreen unit, a steering, an operator console, switches, levers, pedals, knobs, buttons, and so on. The controls are adapted to control the machine 100 on a work surface 108. Additionally, the machine 100 may include components and/or systems (not shown), such as a fuel delivery system, an air delivery system, a lubrication system, a propulsion system, a drivetrain, a drive control system, a machine control system, a ballast system, and so on, based on application requirements.

The machine 100 further includes at least one compaction member. In the illustrated embodiment, the machine 100 includes two compaction members, such as a first compaction member 110 and a second compaction member 112. The first compaction member 110 will be hereinafter interchangeably referred to as the "first member 110". The second compaction member 112 will be hereinafter interchangeably referred to as the "second member 112". Each of the first member 110 and the second member 112 is disposed spaced apart from one another along the longitudinal axis X-X'.

Each of the first member 110 and the second member 112 is rotatably mounted to the frame 102. Also, each of the first member 110 and the second member 112 is operably coupled to the power source. Each of the first member 110 and the second member 112 performs compaction of the work surface 108, such as an asphalt surface, a soil surface, and so on, based on application requirements. Each of the first member 110 and the second member 112 also supports and provides mobility to the machine 100 on the work surface 108. Each of the first member 110 and the second member 112 has a substantially hollow and cylindrical configuration. Accordingly, the first member 110 defines a first side 114 and a second side 116. The second side 116 is disposed opposite to the first side 114. Also, the second member 112 defines a first side 118 and a second side 120. The second side 120 is disposed opposite to the first side 118.

In the illustrated embodiment, each of the first member 110 and the second member 112 is a smooth type compaction member. In other embodiments, one or more of the first member 110 and the second member 112 may be a set of pneumatic rollers, based on application requirements. In a situation when the machine 100 may be a single drum type compaction machine, the second member 112 may be omitted. In such a situation, the machine 100 may include one or more ground engaging members. The ground engaging members may be rotatably mounted to the frame 102 and disposed spaced apart from the first member 110 along the longitudinal axis X-X'. The ground engaging members may be any one of a set of wheels, pneumatic rollers, tracks, and so on, based on application requirements.

The machine 100 also includes at least one pneumatic tire movably coupled to the frame 102. More specifically, in the illustrated embodiment, the machine 100 includes a number of pneumatic tires, such as a first pneumatic tire 122, a second pneumatic tire 124, a third pneumatic tire (not shown), and a fourth pneumatic tire (not shown). The first pneumatic tire 122 will be hereinafter interchangeably referred to as the "first tire 122". The second pneumatic tire 124 will be hereinafter interchangeably referred to as the "second tire 124". The third pneumatic tire will be hereinafter interchangeably referred to as the "third tire". The fourth pneumatic tire will be hereinafter interchangeably referred to as the "fourth tire".

Also, the at least one pneumatic tire is disposed on at least one of the first side 114, 118 and the second side 116, 120 of the at least one compaction member. More specifically, the first tire 122 is disposed on the first side 114 of the first member 110. The second tire 124 is disposed on the first side 118 of the second member 112. The third tire is disposed on the second side 116 of the first member 110. The fourth tire is disposed on the second side 120 of the second member 112. Each of the first tire 122, the second tire 124, the third tire, and the fourth tire may be made of any inflatable material, such as rubber.

In the illustrated embodiment, the machine 100 includes four pneumatic tires. In other embodiments, the machine 100 may include a single pneumatic tire, such as any one of the first tire 122, the second tire 124, the third tire, or the fourth tire. In some embodiments, the machine 100 may include a combination of pneumatic tires, such as the first tire 122 and the second tire 124, the third tire and the fourth tire, the first tire 122 and the third tire, the second tire 124 and the fourth tire, and so on, based on application requirements.

The at least one pneumatic tire will be now explained with reference to the first tire 122 and the first member 110. The first tire 122 is disposed adjacent to an edge 126 of the first member 110. More specifically, the first tire 122 is movably coupled adjacent to the edge 126. The first tire 122 is adapted to selectively move between a retracted position "RPt" (shown in FIG. 1A) and a deployed position "DP" (shown in FIG. 1B). Accordingly, the machine 100 includes an actuation system 128. The actuation system 128 is adapted to selectively move the at least one pneumatic tire between the retracted position "RPt" and the deployed position "DP". The actuation system 128 includes an actuation arm 130. The actuation arm 130 is pivotally coupled to the frame 102 via a pivot joint 132. Further, the first tire 122 is rotatably coupled to the actuation arm 130.

The actuation system 128 also includes an actuation member 134. The actuation member 134 is movably coupled between the frame 102 and the actuation arm 130. In the illustrated embodiment, the actuation member 134 is a fluid powered actuator, such as a hydraulic actuator, a pneumatic actuator, and so on. In other embodiments, the actuation member 134 may be any other actuator, such as an electrically powered actuator, a magnetically powered actuator, and so on, based on application requirements. The actuation member 134 is adapted to move between a retracted position "RPa" and an extended position "EP".

In the retracted position "RPa" of the actuation member 134, the first tire 122 is selectively moved in the retracted position "RPt". In the retracted position "RPt" of the first tire 122, the first tire 122 is raised relative to the work surface 108 (shown in FIG. 1A). In the extended position "EP" of the actuation member 134, the first tire 122 is selectively moved in the deployed position "DP". In the deployed position "DP" of the first tire 122, the first tire 122 contacts the work surface 108 (shown in FIG. 1B). As such, in the deployed position "DP", the first tire 122 is adapted to provide selective compaction of a portion of the work surface 108. In other embodiments, the actuation member 134 may be configured and orientated in a manner such that in the retracted position "RPa" of the actuation member 134, the first tire 122 is selectively moved in the deployed position "DP", and in the extended position "EP" of the actuation member 134, the first tire 122 is selectively moved in the retracted position "RPt".

Figure 2:
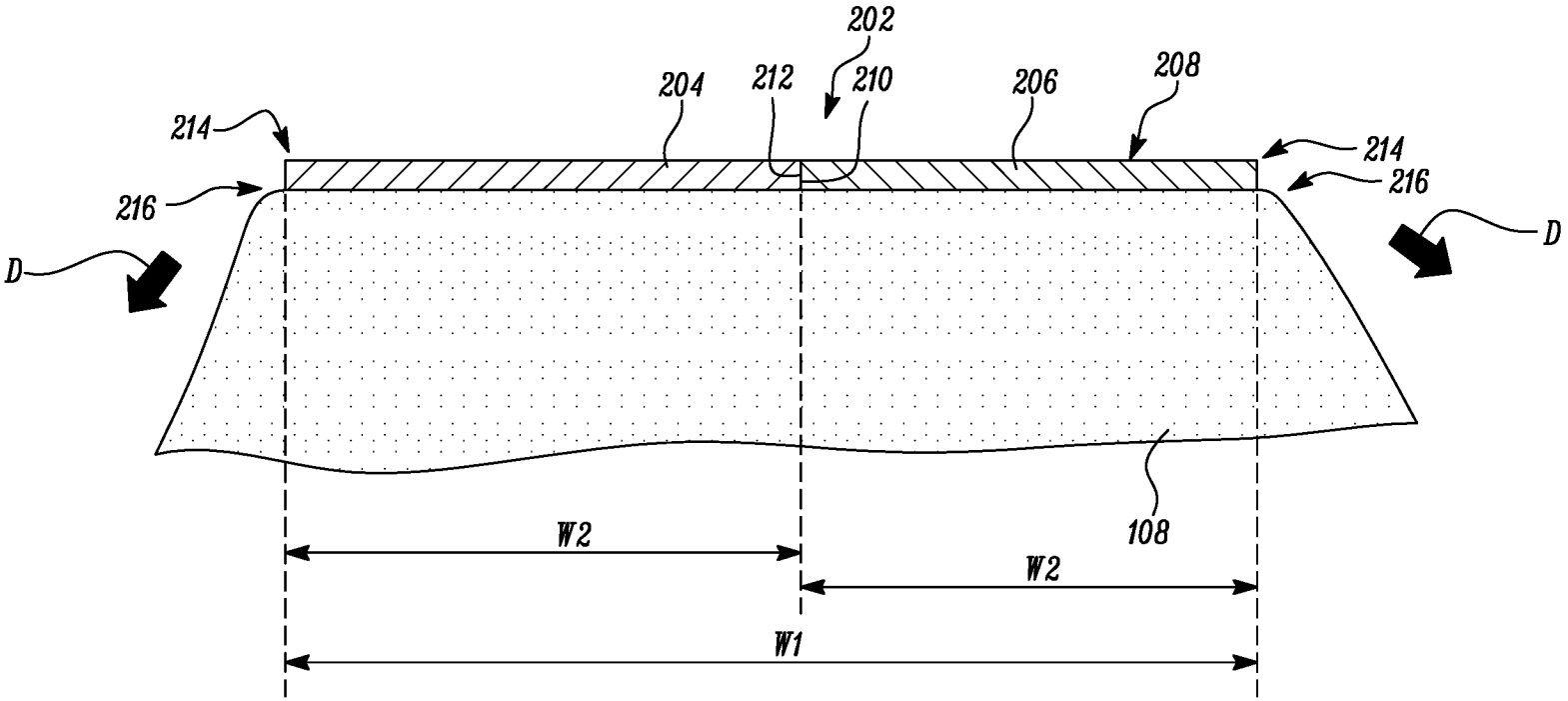
FIG. 2 is a cross sectional view of an exemplary work surface and an exemplary asphalt surface, according to one embodiment of the present disclosure.

Referring to FIG. 2, in one embodiment, the portion of the work surface 108 may be a longitudinal joint 202 of adjacent layers 204, 206 of an asphalt surface 208. For example, in some situations, when a width "W1" of the work surface 108 may be greater than a width "W2" of a paving machine (not shown), multiple layers 204, 206 of the asphalt surface 208 may be formed such that each of the multiple layers 204, 206 may be formed adjacent to one another. In such a situation, edges 210, 212 of the adjacent layers 204, 206 of the asphalt surface 208 may be disposed adjacent to one another, thus, forming the longitudinal joint 202 of the adjacent layers 204, 206 of the asphalt surface 208. Accordingly, the first tire 122 may be aligned and rolled over the longitudinal joint 202 in order to provide compaction of the adjacent layers 204, 206 of the asphalt surface 208. Additionally, a compaction force/pressure of the first tire 122 may be controlled by controlling an extension/retraction of the actuation member 134 and/or an air pressure within the first tire 122 and, thus, a rolling force of the first tire 122 on the longitudinal joint 202 of the adjacent layers 204, 206 of the asphalt surface 208.

In another embodiment, the portion of the work surface 108 may be an edge portion 214 of the asphalt surface 208. In many situations, the edge portion 214 of the asphalt surface 208 may be formed on an edge portion 216 of the work surface 108. During compaction of the edge portion 214, a weight of the machine 100 may push the edge portion 214 of the asphalt surface 208 over the edge portion 216 of the work surface 108 in a direction "D". As such, a desired level of compaction and/or surface finish may not be achieved around the edge portion 214 of the asphalt surface 208. In such a situation, the first tire 122 may be aligned and rolled over the edge portion 214 of the asphalt surface 208 in order to limit the compaction force/pressure on the edge portion 214 of the asphalt surface 208. Additionally, the compaction force/pressure may be controlled by controlling the extension/retraction of the actuation member 134 and/or the air pressure within the first tire 122 and, thus, the rolling force of the first tire 122 on the edge portion 214 of the asphalt surface 208.

Figure 3:
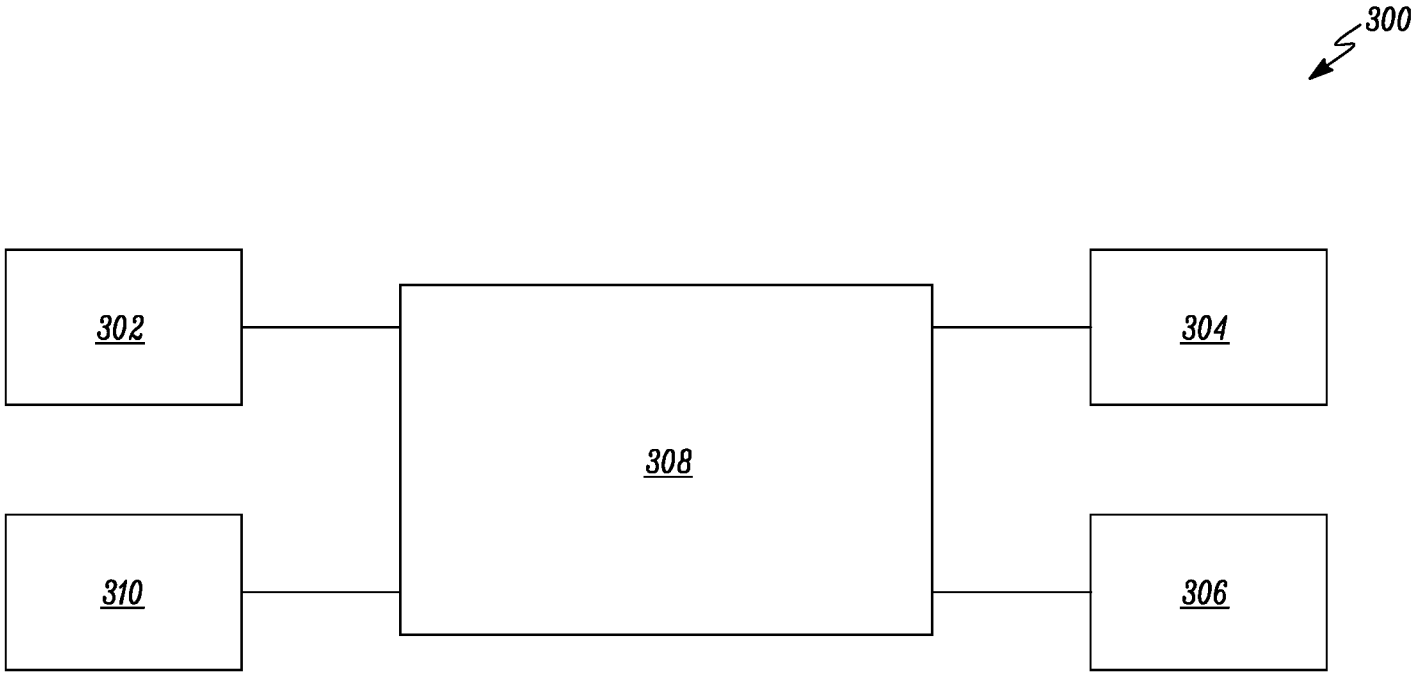
FIG. 3 is a schematic representation of a pressure control system of the compaction machine, according to one embodiment of the present disclosure.

Referring to FIG. 3, the machine 100 further includes a pressure control system 300. The pressure control system 300 will be hereinafter interchangeably referred to as the "system 300". The system 300 is disposed in association with the at least one pneumatic tire, such as the first tire 122. The system 300 includes a pressure sensor 302. The pressure sensor 302 is disposed in association with the first tire 122. As such, the pressure sensor 302 is configured to generate a signal indicative of the air pressure within the first tire 122.

The pressure sensor 302 may be any pressure sensor, such as a piezoelectric type pressure sensor, a piezoresistive type pressure sensor, a capacitive type pressure sensor, an electromagnetic type pressure sensor, an optical type pressure sensor, and so on, based on application requirements. In some embodiments, the pressure sensor 302 may be associated with a Tire Pressure Monitoring System (TPSM) of the machine 100. The pressure sensor 302 may be disposed in any location, such as within the first tire 122, in fluid communication with a fluid line (not shown) coupled to the first tire 122, and so on, based on application requirements.

The system 300 also includes a compressor unit 304. The compressor unit 304 will be hereinafter interchangeably referred to as the "compressor 304". The compressor 304 is fluidly coupled to the first tire 122. Accordingly, the compressor 304 is adapted to provide a flow of pressurized air to the first tire 122. The compressor 304 may be any air compression unit, such as a rotary screw type compressor, a reciprocating type compressor, an axial type compressor, a centrifugal type compressor, and so on, based on application requirements.

The system 300 also includes a release valve 306. The release valve 306 will be hereinafter interchangeably referred to as the "valve 306". The valve 306 is fluidly coupled to the first tire 122. The valve 306 is adapted to release the pressurized air from the first tire 122. The valve 306 may be any pneumatic flow control valve, such as a needle type pneumatic valve, a ball type pneumatic valve, a butterfly type pneumatic valve, and so on, based on application requirements.

The system 300 further includes a controller 308. The controller 308 may be any control unit configured to perform various functions of the system 300. In one embodiment, the controller 308 may be a dedicated control unit configured to perform functions related to the system 300. In another embodiment, the controller 308 may be a Machine Control Unit (MCU) associated with the machine 100, an Engine Control Unit (ECU) associated with the engine, and so on configured to perform functions related to the system 300.

The controller 308 is communicably coupled to each of the pressure sensor 302, the compressor 304, and the valve 306. Accordingly, the controller 308 is configured to receive the signal indicative of the air pressure within the first tire 122 from the pressure sensor 302. Based on the received signal and a predefined pressure, the controller 308 is configured to actuate one of the compressor 304 and the valve 306. In the illustrated embodiment, the system 300 includes an operator interface 310 communicably coupled to the controller 308. The operator interface 310 is adapted to generate a signal indicative of the predefined pressure based on an operator input.

More specifically, the operator interface 310 may be any input device, such as a touchscreen unit, a button, a knob, a speech recognition unit, and so on. As such, the operator may input any value of the predefined pressure using the operator interface 310. Accordingly, the operator interface 310 generates the signal indicative of the predefined pressure and is communicated to the controller 308. In another embodiment, one or more values of the predefined pressure may be preset or stored in a database (not shown) communicably coupled to controller 308 or an internal memory (not shown) of the controller 308. The one or more values of the predefined pressure may correspond to different compaction modes of the machine 100. Accordingly, the controller 308 may retrieve the value of the predefined pressure from the database or the internal memory of the controller 308 corresponding to a selected compaction mode of the machine 100.

Based on the predefined pressure, the controller 308 is further configured to control the air pressure within the first tire 122. In one embodiment, the controller 308 is configured to actuate the compressor 304 based on the air pressure within the first tire 122 dropping below the predefined pressure. For example, in one situation, when the air pressure within the first tire 122 may be approximately 80 pound per square inch (psi) and the operator may select a relatively higher value of the predefined pressure, such as approximately 100 psi, the controller 308 may actuate the compressor 304 in order to provide the flow of pressurized air to the first tire 122. Further, the controller 308 may deactivate the compressor 304 when the air pressure within the first tire 122 may reach approximately 100 psi, i.e. approximately equal to the selected value of the predefined pressure.

In another situation when the value of the predefined pressure may be approximately 100 psi and the air pressure within the first tire 122 may drop below the predefined pressure, such as due to loss of the air pressure during an idle state of the machine 100, drop in ambient temperature, and so on, the controller 308 may actuate the compressor 304 in order to provide the flow of pressurized air to the first tire 122. Further, the controller 308 may deactivate the compressor 304 when the air pressure within the first tire 122 may reach approximately 100 psi, i.e. approximately equal to the selected value of the predefined pressure. In some embodiments, the compressor 304 may be directly controlled using the controller 308. In some embodiments, the compressor 304 may be controlled using an electronic switch (not shown), such as a solenoid switch, communicably coupled to each of the compressor 304 and the controller 308.

In another embodiment, the controller 308 is configured to actuate the valve 306 based on the air pressure within the first tire 122 exceeding the predefined pressure. For example, in one situation, when the air pressure within the first tire 122 may be approximately 110 psi and the operator may select a relatively lower value of the predefined pressure, such as approximately 100 psi, the controller 308 may actuate the valve 306 in an open position in order to release the pressurized air from the first tire 122. Further, the controller 308 may deactivate the valve 306 in a closed position when the air pressure within the first tire 122 may reach approximately 100 psi, i.e. approximately equal to the selected value of the predefined pressure.

In another situation when the value of the predefined pressure may be approximately 100 psi and the air pressure within the first tire 122 may exceed the predefined pressure, such as during rotation of the first tire 122 on the asphalt surface 208 having a relatively higher temperature, increase in ambient temperature, and so on, the controller 308 may actuate the valve 306 in the open position in order to release the pressurized air from the first tire 122. Further, the controller 308 may deactivate the valve 306 in the closed position when the air pressure within the first tire 122 may reach approximately 100 psi, i.e. approximately equal to the selected value of the predefined pressure. Accordingly, the controller 308 controls the air pressure within the first tire 122 at the predefined pressure.

It should be noted that values of the predefined pressure described herein are merely exemplary and may vary based on application requirements. It should also be noted that although the system 300 is described herein with reference to the first tire 122, the system 300 may be employed independently and/or in parallel configuration with one or more of the second tire 124, the third tire, and/or the fourth tire. It should further be noted that although the at least one compaction member is described herein with reference to the first tire 122, other compaction members such as the second tire 124, the third tire, and/or the fourth tire may have a configuration, shape, construction, orientation, operability, and so on similar to a configuration, shape, construction, orientation, operability, and so on of the first tire 122.

INDUSTRIAL APPLICABILITY

Figure 4:
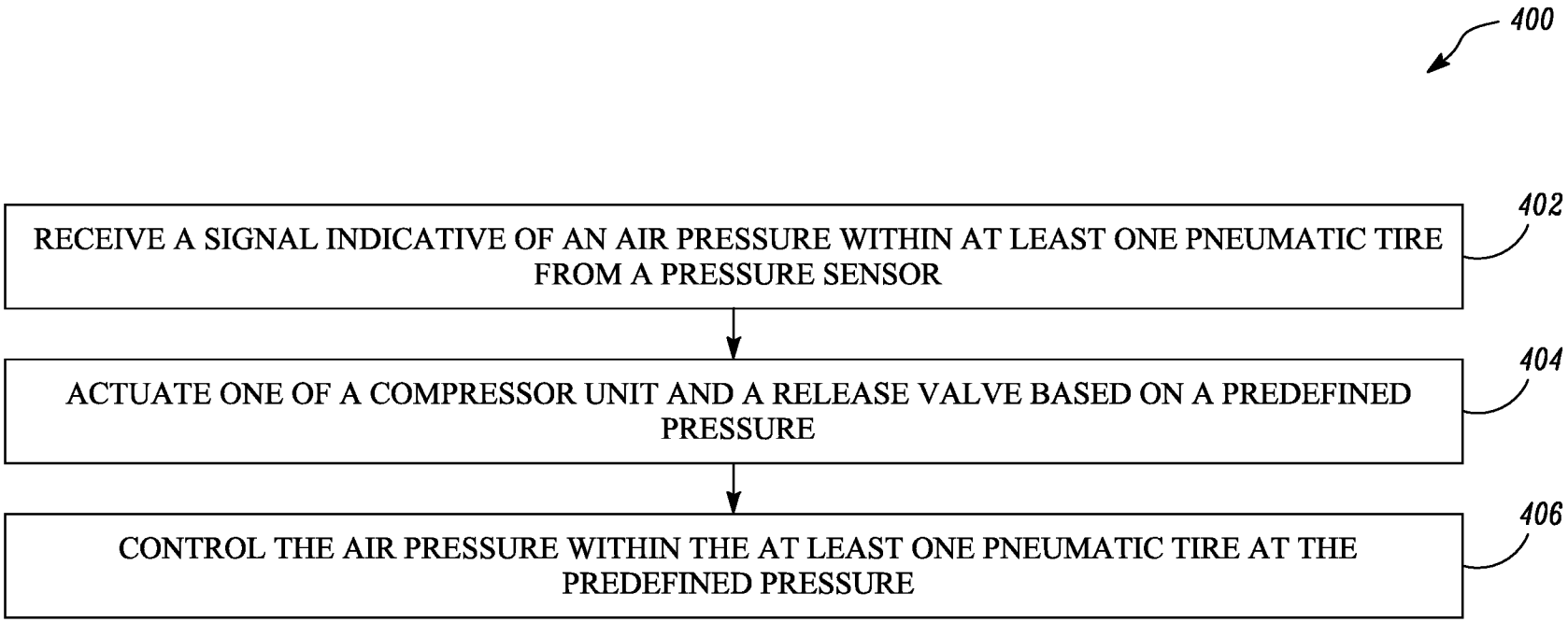
FIG. 4 is a flowchart illustrating a method of working of the pressure control system, according to one embodiment of the present disclosure.

The present disclosure relates to a method 400 for controlling the air pressure within the at least one pneumatic tire, such as the first tire 122. The at least one pneumatic tire is associated with the at least one compaction member, such as the first member 110, of the machine 100. Referring to FIG. 4, a flowchart of the method 400 is illustrated. The method 400 will be now explained with reference to the first tire 122. It should be noted that, in other embodiments, the method 400 may be employed independently and/or in parallel configuration for one or more of the second tire 124, the third tire, and/or the fourth tire.

At step 402, the controller 308 receives the signal indicative of the air pressure within the first tire 122 from the pressure sensor 302. At step 404, the controller 308 actuates one of the compressor 304 and the valve 306 based on the predefined pressure. In one situation, the value of the predefined pressure may be preset or stored in the database or the internal memory of the controller 308. In another situation, the operator may provide the value of the predefined pressure using the operator interface 310. Accordingly, the controller 308 may receive the signal indicative of the predefined pressure from the operator interface 310 based on the operator input.

In one embodiment, the controller 308 may actuate the compressor 304 based on the air pressure within the first tire 122 dropping below the predefined pressure. The air pressure within the first tire 122 may drop below the predefined pressure in situations, such as selecting the relatively higher value of the predefined pressure by the operator, loss of the air pressure during the idle state of the machine 100, drop in ambient temperature, and so on.

In another embodiment, the controller 308 may actuate the valve 306 based on the air pressure within the first tire 122 exceeding the predefined pressure. The air pressure within the first tire 122 may exceed the predefined pressure in situations, such as selecting the relatively lower value of the predefined pressure by the operator, increase in ambient temperature, and so on. Further the controller 308 is configured to deactivate the compressor 304 or the valve 306, as the case may be, when the air pressure in the first tire 122 may be approximately equal to the predefined pressure. Accordingly, at step 406, the controller 308 controls the air pressure within the first tire 122 at the predefined pressure.

The first tire 122 provides a simple, effective, and cost-efficient method of selectively compacting the portion of the work surface 108, such as the longitudinal joint 202 of the adjacent layers 204, 206 of the asphalt surface 208, the edge portion 214 of the asphalt surface 208, and so on. As such, the first tire 122 may reduce additional compaction passes of the machine 100 required for the compaction of the portion of the work surface 108, in turn, reducing process time and costs. The first tire 122 may be mounted on any compaction machine using the actuation system 128. As such, the first tire 122 may eliminate use of additional/specialized machines required for the compaction of the portion of the work surface 108, in turn, reducing costs.

Further, the system 300 provides a simple, effective, and cost-efficient method of controlling the air pressure within the first tire 122. As such, the air pressure within the first tire 122 may be controlled on-the-run during a compaction process, in turn, improving usability and reducing machine downtime. Also, varying the air pressure within the first tire 122 may provide varying levels of compaction of the work surface 108, in turn, improving usability, improving process quality, and so on. The first tire 122 and the system 300 may be retrofitted on any compaction machine, in turn, improving flexibility, usability, and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A compaction machine comprising:

a frame defining a longitudinal axis;

at least one compaction member rotatably mounted to the frame, the at least one compaction member defining a first side and a second side disposed opposite to the first side; and at least one pneumatic tire movably coupled to the frame, the at least one pneumatic tire disposed on at least one of the first side and the second side of the at least one compaction member and adjacent to a circumferential edge of the at least one compaction member, the at least one pneumatic tire adapted to selectively move between a deployed position and a retracted position, wherein, in the retracted position, the at least one pneumatic tire is raised relative to a work surface and is disposed radially inward of the circumferential edge, and wherein, in the deployed position, the at least one pneumatic tire is adapted to provide selective compaction of a portion of the work surface.

2. The compaction machine of claim 1, wherein the portion of the work surface is a longitudinal joint of adjacent layers of an asphalt surface.

3. The compaction machine of claim 1, wherein the portion of the work surface is an edge portion of an asphalt surface.

4. The compaction machine of claim 1, wherein the at least one pneumatic tire is selectively moved between the deployed position and the retracted position using an actuation system.

5. The compaction machine of claim 1, wherein the at least one compaction member includes a first compaction member and a second compaction member, each of the first compaction member and the second compaction member disposed spaced apart from one another along the longitudinal axis.

6. The compaction machine of claim 5, wherein the at least one pneumatic tire includes a first pneumatic tire disposed on the first side of the first compaction member.

7. The compaction machine of claim 6, wherein the at least one pneumatic tire includes a second pneumatic tire disposed on a first side of the second compaction member.

8. The compaction machine of claim 6, wherein the at least one pneumatic tire includes a third pneumatic tire disposed on the second side of the first compaction member.

9. The compaction machine of claim 6, wherein the at least one pneumatic tire includes a fourth pneumatic tire disposed on a second side of the second compaction member.

10. The compaction machine of claim 1 further includes a pressure control system disposed in association with the at least one pneumatic tire, the pressure control system including:

a pressure sensor disposed in association with the at least one pneumatic tire, the pressure sensor configured to generate a signal indicative of an air pressure within the at least one pneumatic tire;

a compressor unit fluidly coupled to the at least one pneumatic tire, the compressor unit adapted to provide a flow of pressurized air to the at least one pneumatic tire;

a release valve fluidly coupled to the at least one pneumatic tire, the release valve adapted to release the pressurized air from the at least one pneumatic tire; and a controller communicably coupled to each of the pressure sensor, the compressor unit, and the release valve, the controller configured to:

receive the signal from the pressure sensor;

actuate one of the compressor unit and the release valve based on a predefined pressure; and control the air pressure within the at least one pneumatic tire at the predefined pressure.

11. The compaction machine of claim 10 further includes an operator interface communicably coupled to the controller, the operator interface adapted to generate a signal indicative of the predefined pressure based on an operator input.

12. The compaction machine of claim 10, wherein the controller is configured to:

actuate the compressor unit based on the air pressure within the at least one pneumatic tire dropping below the predefined pressure; and actuate the release valve based on the air pressure within the at least one pneumatic tire exceeding the predefined pressure.

13. A pressure control system for at least one pneumatic tire associated with a compaction member of a compaction machine, the compaction machine including a frame defining a longitudinal axis, the compaction member defining a first side and a second side disposed opposite to the first side, the compaction member including a cylindrical body that extends between the first side and the second side and includes a circumferential edge, the at least one pneumatic tire disposed on the first side and movably coupled to the frame, the at least one pneumatic tire adapted to selectively move between a deployed position and a retracted position, wherein in the retracted position the at least one pneumatic tire is raised relative to a work surface and is disposed radially inward of the circumferential edge, and wherein in the deployed position the at least one pneumatic tire is adapted to provide selective compaction of a portion of the work surface that includes an edge of the work surface or a longitudinal joint that joins first and second adjacent layers of the work surface, the pressure control system including:

a pressure sensor disposed in association with the at least one pneumatic tire, the pressure sensor configured to generate a signal indicative of an air pressure within the at least one pneumatic tire;

a compressor unit fluidly coupled to the at least one pneumatic tire, the compressor unit adapted to provide a flow of pressurized air to the at least one pneumatic tire;

a release valve fluidly coupled to the at least one pneumatic tire, the release valve adapted to release the pressurized air from the at least one pneumatic tire; and a controller communicably coupled to each of the pressure sensor, the compressor unit, and the release valve, the controller configured to:

receive the signal from the pressure sensor;

actuate one of the compressor unit and the release valve based on a predefined pressure for the at least one pneumatic tire in the deployed position compacting the edge of the work surface adjacent to the first side or the longitudinal joint adjacent to the first side; and control the air pressure within the at least one pneumatic tire at the predefined pressure.

14. The pressure control system of claim 13 further includes an operator interface communicably coupled to the controller, the operator interface adapted to generate a signal indicative of the predefined pressure based on an operator input.

15. The pressure control system of claim 13, wherein the controller is configured to actuate the compressor unit based on the air pressure within the at least one pneumatic tire dropping below the predefined pressure.

16. The pressure control system of claim 13, wherein the controller is configured to actuate the release valve based on the air pressure within the at least one pneumatic tire exceeding the predefined pressure.

17. A method for controlling an air pressure within at least one pneumatic tire associated with at least one compaction member of a compaction machine, the compaction machine including a frame defining a longitudinal axis, the compaction member defining a first side and a second side disposed opposite to the first side, the compaction member including a cylindrical body that extends between the first side and the second side and includes a circumferential edge, the at least one pneumatic tire disposed on the first side and movably coupled to the frame, the at least one pneumatic tire adapted to selectively move between a deployed position and a retracted position, wherein in the retracted position the at least one pneumatic tire is raised relative to a work surface and is disposed radially inward of the circumferential edge, and wherein in the deployed position the at least one pneumatic tire is adapted to provide selective compaction of a portion of the work surface that includes an edge of the work surface or a longitudinal joint that joins first and second adjacent layers of the work surface, the method comprising:

receiving a signal indicative of the air pressure within the at least one pneumatic tire from a pressure sensor;

actuating one of a compressor unit and a release valve based on a predefined pressure for the at least one pneumatic tire in the deployed position compacting the edge of the work surface adjacent to the first side or the longitudinal joint adjacent to the first side; and controlling the air pressure within the at least one pneumatic tire at the predefined pressure.

18. The method of claim 17 further includes receiving a signal indicative of the predefined pressure from an operator interface based on an operator input.

19. The method of claim 17, wherein the compressor unit is actuated based on the air pressure within the at least one pneumatic tire dropping below the predefined pressure.

20. The method of claim 17, wherein the release valve is actuated based on the air pressure within the at least one pneumatic tire exceeding the predefined pressure.

* * * * *